US011117413B1

(12) United States Patent
Stegemiller et al.

(10) Patent No.: US 11,117,413 B1
(45) Date of Patent: Sep. 14, 2021

(54) GIFT CARD CARRIER

(71) Applicant: Iosue Associates, Inc., Lake Forest, IL (US)

(72) Inventors: Jayne Stegemiller, Lake Forest, IL (US); Mary Parks, Lake Forest, IL (US)

(73) Assignee: IOSUE ASSOCIATES, INC., Lake Forest, IL (US)

( * ) Notice: Subject to any disclaimer, the term of this patent is extended or adjusted under 35 U.S.C. 154(b) by 0 days.

(21) Appl. No.: 16/807,760

(22) Filed: Mar. 3, 2020

(51) Int. Cl.
*B42D 15/04* (2006.01)
*B42D 25/20* (2014.01)
*A45C 11/18* (2006.01)

(52) U.S. Cl.
CPC ..... *B42D 15/045* (2013.01); *A45C 11/182* (2013.01); *B42D 25/285* (2014.10)

(58) Field of Classification Search
CPC .. B42D 15/045; B42D 25/285; B42D 15/022; A45C 11/182; A45C 11/18; B65D 77/20; B65D 81/365; B65D 43/20; G09F 1/10; G09F 2001/085; G09F 1/08
See application file for complete search history.

(56) References Cited

U.S. PATENT DOCUMENTS 4,697,364 A * 10/1987 Dean ..... G09F 1/12 40/445
7,056,122 B2 * 6/2006 Lockett ..... G09B 1/00 116/240
D643,061 S * 8/2011 McClain ..... D19/7
8,215,641 B2 * 7/2012 Hacker ..... A63F 1/00 273/292
9,139,353 B2 * 9/2015 Glass ..... B65D 81/365
9,987,871 B1 * 6/2018 Larson ..... B42D 15/022
2004/0093773 A1 * 5/2004 Clark ..... B42D 15/045 40/124.06
2009/0217559 A1 * 9/2009 Sayre ..... B42D 15/022 40/124.06
2012/0205281 A1 * 8/2012 Glass ..... B65D 27/00 206/556
2012/0285968 A1 * 11/2012 Glass ..... B42D 15/045 220/345.1
2013/0126371 A1 * 5/2013 Glass ..... B65D 73/0007 206/232
2014/0216982 A1 * 8/2014 Boyer ..... B42D 15/045 206/758
2014/0231278 A1 * 8/2014 Glass ..... G06Q 20/387 206/39
2015/0224808 A1 * 8/2015 Shlonsky ..... B42D 15/027 40/124.02
2017/0334231 A1 * 11/2017 McClain ..... B42D 15/022
2019/0070886 A1 * 3/2019 Nelson ..... B65D 77/20

* cited by examiner

*Primary Examiner* — Cassandra Davis
(74) *Attorney, Agent, or Firm* — Leason Ellis LLP

(57) ABSTRACT

A gift card carrier for holding a gift card includes a first part having a first portion and a second portion that is formed of a transparent plastic material and includes a pair of gift card slits for releasably retaining the gift card. The gift card carrier also has a second part that has an open interior space. The second portion of the first part is sized to carry the gift card and be received within the open interior space of the second part. The first part moves between a fully retracted position in which the second portion is received within the open interior space and an extended position in which the second portion is exposed for removal of the gift card.

8 Claims, 5 Drawing Sheets

GIFT CARD CARRIER

TECHNICAL FIELD

The present invention relates to gift card carriers and more specifically, to a decorative gift card or money carrier (holder) which is formed of a base part and a removable part that has a first section formed of one material and a second section formed of a different second material that is transparent and is received within an interior space of the base part in a concealed (first) state of the gift card carrier.

BACKGROUND

Gift card have become very common in recent years as a gift to a person on a special occasion such as a holiday or birthday.

Generally, a gift card is a prepaid debit card that contains a specific amount of money available for use for a variety of purchases. A gift card is thus loaded with funds for future use. Traditionally, there are two types of gift cards, namely, open loop gift cards and closed loop gift cards. Both gift card types can be used online and in person. Closed loop gift cards are those that are typically marketed by stores that allow the cardholder to purchase anything from that specified retailer. Closed loop cards can generally only be used with a single merchant, either at the store or on its website. However, if one company owns several different retailers, it might issue gift cards that can be used at any of the retailers. The gift cards will display the brands and associated company logos. Conversely, open loop cards offer the equivalent of cash and are essentially a credit or debit card that can be used at any merchant where that card is accepted, as well as online. Many of the major charge or credit card issuers/processors, like. American Express, Visa, Discover, and MasterCard, offer open loop gift cards. These cards will display the payment processor's logo and can be used to make all types of electronic payments nearly anywhere.

Physically, gift cards look very much like credit or debit cards and are in the form of a rectangular shaped card typically made of plastic.

Often times, gift cards are presented to the recipient with a gift card carrier or box that retains the gift card and often times has a decorative face.

SUMMARY

In one embodiment, a gift card carrier for holding a gift card includes a first part having a first portion and a second portion that has a pair of guide tabs and a second part that has an open interior space and has a pair of guide slits formed in at least one face thereof. The guide tabs passes through the guide slits for controlling movement of the first part relative to the second part. The second portion is sized to carry the gift card and be received within the open interior space of the second part. In addition, the first part moves between a fully retracted position in which the second portion is received within the open interior space and an extended position in which the second portion is exposed for removal of the gift card.

In another embodiment, a gift card carrier for holding a gift card includes a first part having a first portion and a second portion that is formed of a transparent plastic material and includes a pair of gift card slits for releasably retaining the gift card. The gift card carrier also has a second part that has an open interior space. The second portion of the first part is sized to carry the gift card and be received within the open interior space of the second part. The first part moves between a fully retracted position in which the second portion is received within the open interior space and an extended position in which the second portion is exposed for removal of the gift card.

BRIEF DESCRIPTION OF THE DRAWING FIGURES

DETAILED DESCRIPTION OF CERTAIN EMBODIMENTS

FIGS. 1-5 illustrate a gift card carrier 100 in accordance with one embodiment of the present disclosure. The gift card carrier 100 is configured to releasably retain a gift card (not shown) and acts not only to protect the gift card during storage and/or transit but also provides a decorative holder that can be given to a recipient. The gift card carrier 100 can thus take any number of different decorative forms and can be selected based on the purchaser's tastes and in view of the likes of the recipient.

The gift card carrier 100 is generally formed of two parts, namely, a first part 110 and a second part 120. The first part 110 can represent a top part and the second part 120 can represent a bottom part. In the illustrated embodiment, the gift card carrier 100 takes the form of a house (e.g., a holiday gingerbread house) and the first part 110 represents a roof of the house and the second part 120 presents a base of the house.

Figure 5:
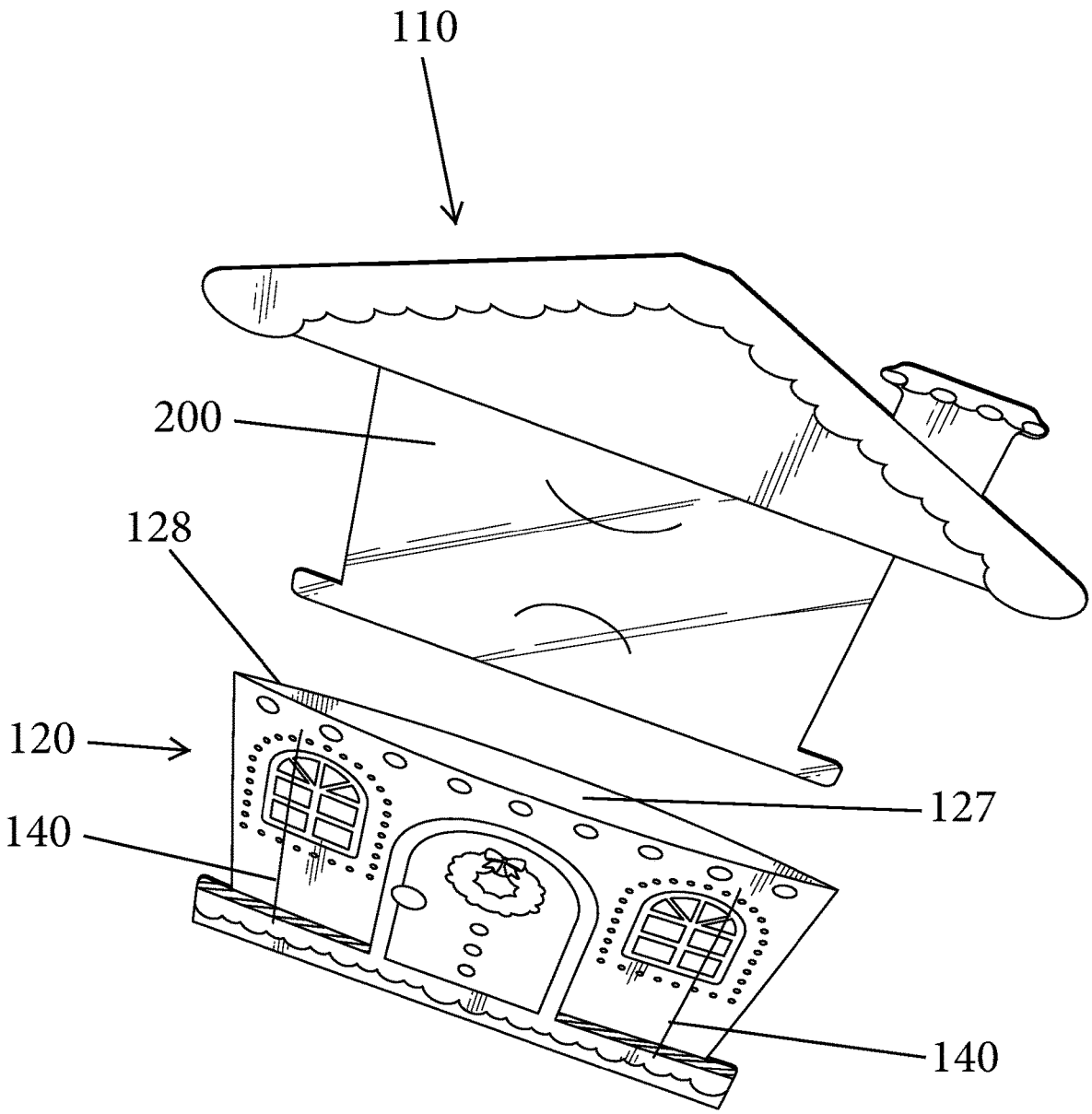
FIG. 5 is a top exploded perspective view of the removable top part and the base.

The second part 120 has a front face 122 and an opposite rear face 124. The second part 120 is formed of a first layer 123 that defines the front face 122 and a second layer 125 that defines the rear face 124. The first layer 123 and the second layer 125 are attached to one another along three sides so as to define an open interior space 127 that is defined between the two layers 123, 125 and is open along a top edge 128 as shown in FIG. 5. The open interior space 127 of the second part 120 thus represents a pocket into which an object, namely, the first part 110, can be placed.

Each of the front face 122 and the rear face 124 can include decorative indicia to convey a theme or otherwise provide a decorative surface. In the illustrated embodiment in which the second part 120 represents the bottom half (base) of the holiday (gingerbread) house, the front and rear faces 122, 124 can depict a wreath adorned door with a pair of windows along with our holiday indicia. It will be appreciated that the front face 122 and the rear face 124 can have different appearances.

The second part 120 can be formed of any number of materials and in particular, can be formed of a paper material with the first layer 123 and the second layer 125 being attached along the three edges (three sides) using conventional techniques, such as the use of adhesive (glue).

There is one main difference between the first (front) layer 123 and the second (rear) layer 125 in that one of the layers 123, 125 includes a pair of guide slits 140 formed therein. In the illustrated embodiment, the second layer 125 is the layer that contains the pair of guide slits 140 and thus, the guide slits 140 are located along the rear of the gift card carrier 100. The pair of slits 140 are oriented parallel to one another. As shown, the slits 140 do not extend completely from the top edge to the bottom edge of each of the layers 123, 125 but instead terminate prior to the top edge and the bottom edge. The slits 140 are spaced apart a first distance (distance A).

The bottom edge of the second part 120 can, as shown, be defined by a wider bottom portion of the second part 120. Graphically, the wider bottom portion can be depicted as a ground surface beneath the base of the house.

The removable first part 110 is, as described herein, configured to be partially received within the open interior space 127 of the second part 120 so as to complete the appearance of the holiday (gingerbread) house and also securely hold and conceal the gift card within the second part 120. The first part 110 has a front face 112 and an opposite rear face 114. The first part 110 is formed of a first layer 113 that defines the front face 112 and a second layer 115 that defines the rear face 114. The first layer 113 and the second layer 115 are attached to one using conventional techniques such as using an adhesive (glue). The combined first layer 113 and the second layer 115 can be thought of as being a first portion of the first part 110.

The removable first part 110 is intended to be complementary to the look of the second part 120 and therefore, when the second part 120 depicts the base of a house, the first part 110 can depict a roof of the house. As shown, each of the first layer 113 and the second layer 115 can depict a snow covered roof with a chimney.

A bottom edge 111 of the first part 110 is intended to be placed in an abutting relationship or in close proximity to the top edge 128 of the second part 120 so as to complete the overall look of the house.

In accordance with the present disclosure, the first part 110 includes a gift card carrying element 200 that is configured to releasably retain and hold the gift card and can be considered to be a second portion of the first part 110. The gift card carrying element 200 has a first end 202 that is interposed between the first layer 113 and the second layer 115 and an opposite second end 204 that is inserted into the open interior space 127. The first end 202 is thus captured between the first layer 113 and the second layer 115. The first end 202 can be coupled to each of the first layer 113 and the second layer 115 using an adhesive or the like.

Most of the gift card carrying element 200 extends outwardly from the first and second layers 113, 115 is exposed and visible.

The gift card carrying element 200 has a pair of slits 210 formed therein that are used to engage edges of the gift card for releasably holding the gift card along the gift card carrying element 200. The slits 210 can be in the form of a pair of semi-circular slits or a pair of angled slits or other types of slits. The gift card is thus held between the slits 210.

Figure 4:
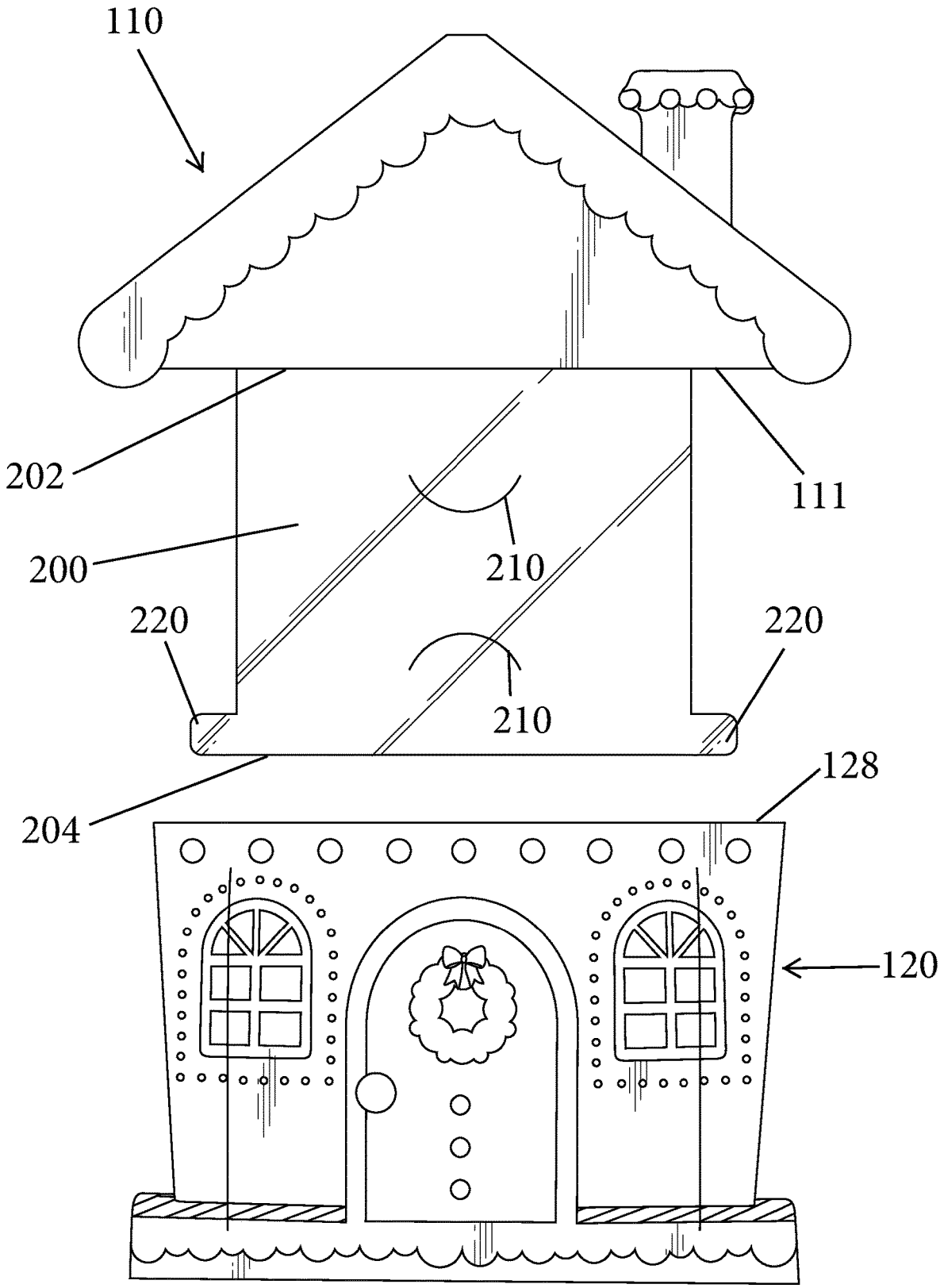
FIG. 4 is rear elevation exploded view of the gift card carrier with the removable top part being completely removed from a base.

As shown in FIG. 4, the second end 204 of the gift card carrying element 200 includes a pair of outwardly extending guide tabs 220 that are preferably integral formed with the rest of the gift card carrying element 200. The gift card carrying element 200 is thus widest at the second end 204 due to the presence of the guide tabs 220.

Figure 3:
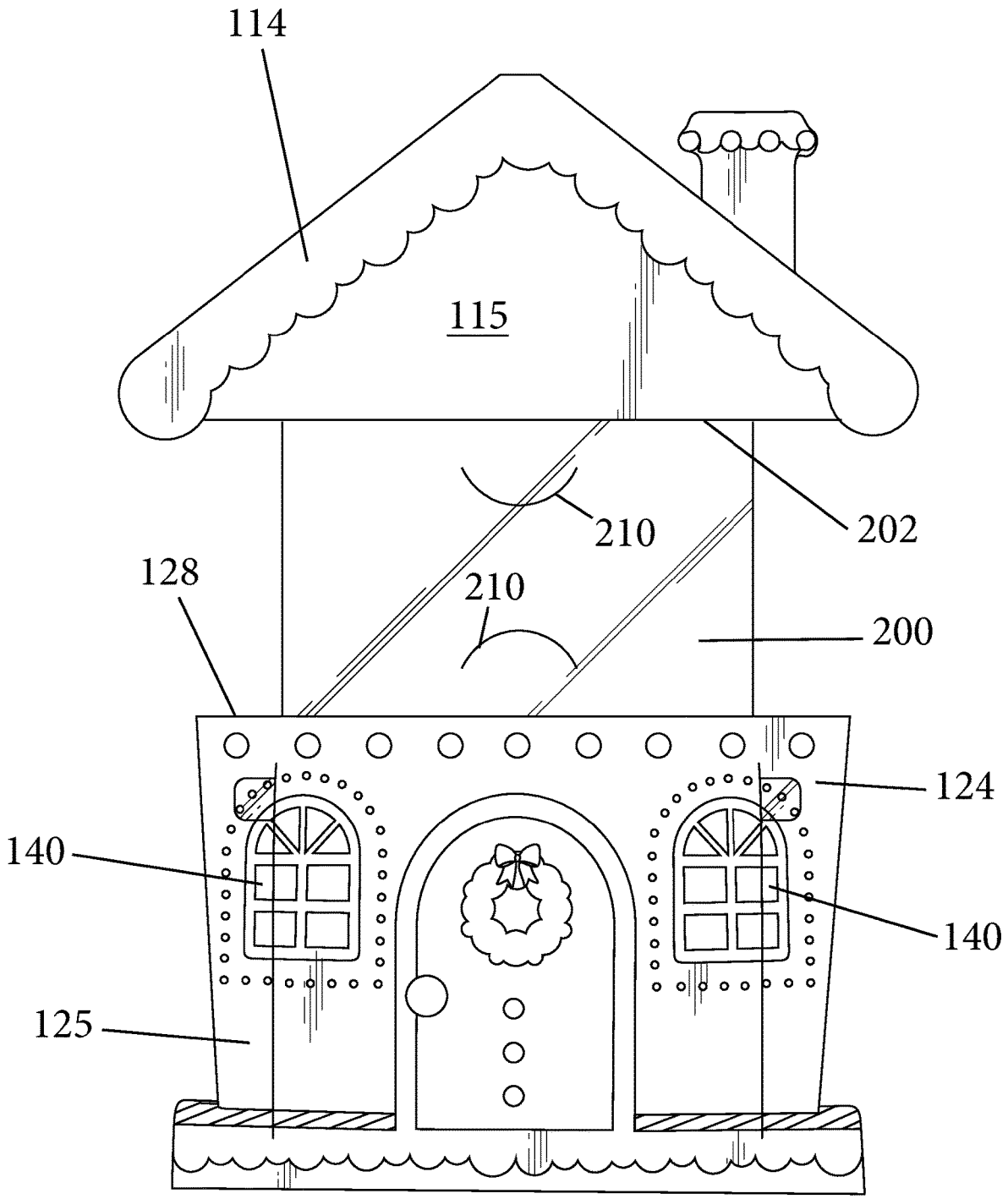
FIG. 3 is a rear elevation view of the gift card carrier with the removable top part being in the extended position.

The guide tabs 220 are purposely formed and configured to be received within the pair of guide slits 140 of the second part 120 and are designed to restrict vertical movement of the first part 110 relative to the second part 120. More specifically, as described herein, the guide tabs 220 are inserted into and pass through the guide slits 140 as shown in FIG. 3. The guide tabs 220 are thus captured within the guide slits 140 and prevent the first part 110 from being freely removed from the second part 120. The reception of the guide tabs 220 within the guide slits 140 also restricts the vertical movement and lateral movement of the first part 110 and more particularly, causes the first part 110 to be extended from the second part 120 in a substantially linear direction with low tolerances of lateral movement.

A second distance (distance B) is defined between outer edges of the tabs 220 with the distance B being greater than the distance A. The remaining portion of the gift card carrying element 200 has a width that is defined by a third distance (distance C) with distances A and C being approximately the same values.

In one embodiment, the gift card carrying element 200 comprises a flexible layer or film formed of a plastic (polymer), such as PVC. The gift card carrying element 200 is thus formed of a material that is preferably different from the material that is used to form the first part 110 and the second part 120. In one embodiment, the gift card carrying element 200 is formed of a transparent material.

Figure 1:
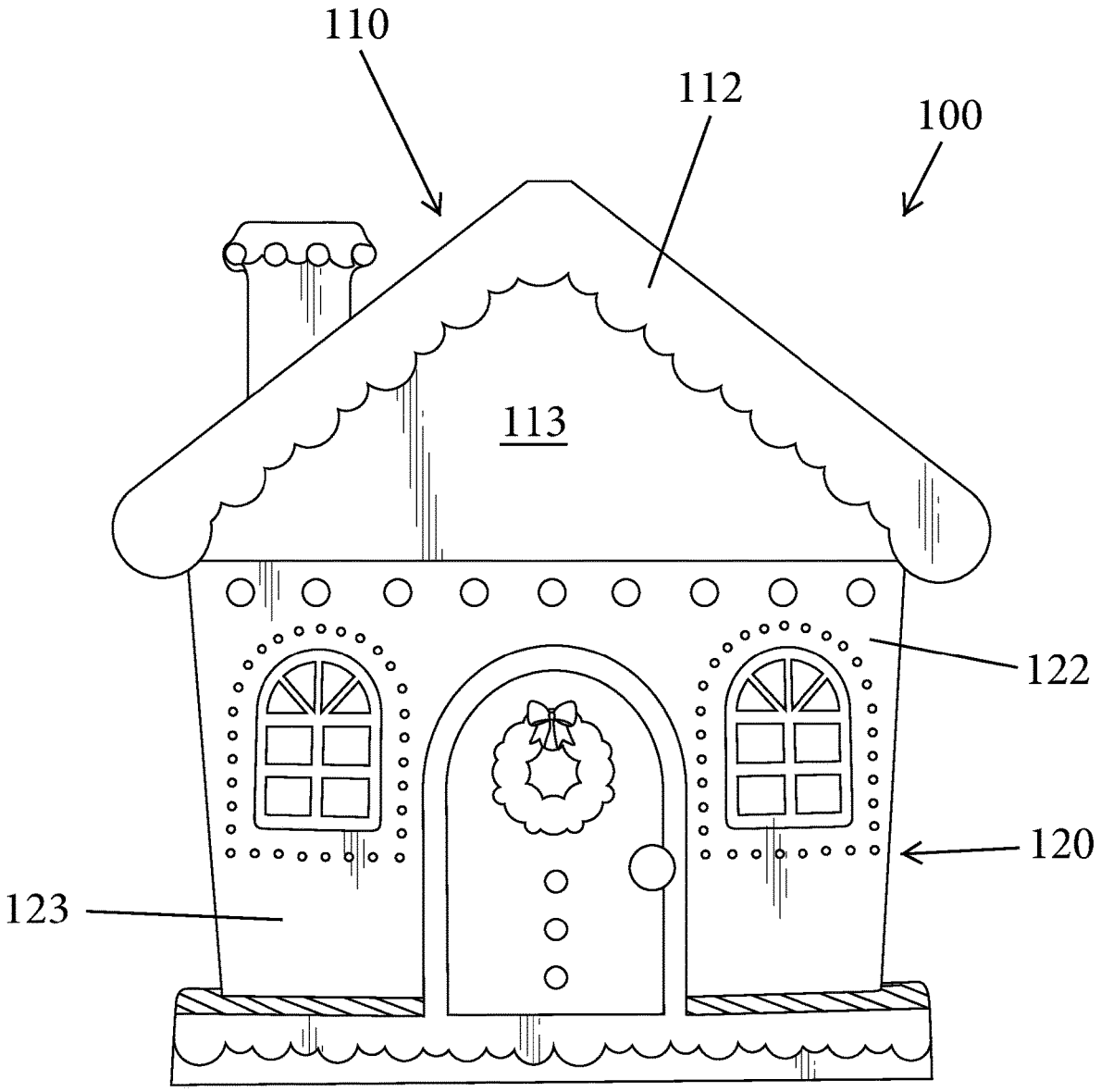
FIG. 1 is a front elevation view of a gift card carrier according to one exemplary embodiment with a removable top part being in a fully extended position.
Figure 2:
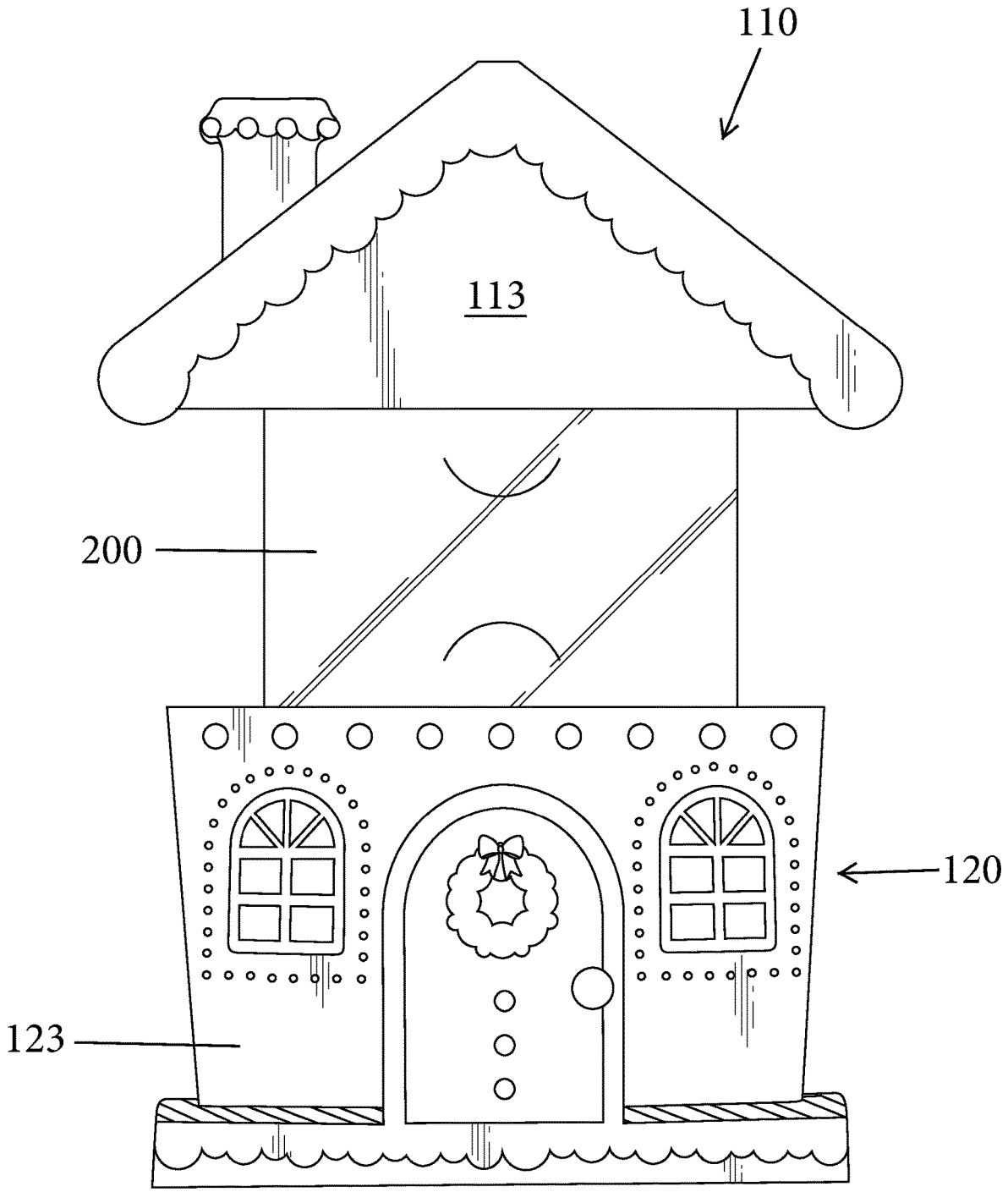
FIG. 2 is a front elevation view of the gift card carrier with the removable top part being in an extended position.

The first part 110 is configured to move between two positions, namely, a fully retracted position shown in FIG. 1 and an extended position shown in FIGS. 2-3. In the fully retracted position, the gift card carrying element 200 is fully contained within the open interior space 127 of the second part 120 and thus, the gift card itself is fully concealed and contained within the open interior space 127. To reveal the gift card, the recipient simply pulls up on the first part 110 (the roof) causing the guide tabs 220 to ride upwardly within the guide slits 140.

Since the gift card carrying element 200 can be formed of a transparent material (e.g., PVC), the gift card carrying element 200 does not detract from the gift card itself. In other words, the recipient's eyes will be immediately drawn to the gift card itself since the gift card is being carried on a transparent surface (element 200) that has no decorative indicia. It will be appreciated that the element 200 is not limited to being formed of a transparent material but instead can also be formed of a plastic element that is formed of a translucent material, semi-translucent material or even opaque plastic material. The element 200 also provides a rigid platform to allow the gift card to stay in place. It also prevents the gift card from being lost or misplaced.

The height of the gift card carrying element 200 is thus selected so that in the fully retracted position, it is fully contained within the open interior space 127 and not visible. Of course, the height of the gift card carrying element 200 must be sufficient so that the gift card can be held thereon and fully contained within the surface area of the gift card carrying element 200.

In the fully retracted position, the guide tabs 220 can thus be located at or near the bottom ends of the guide slits 140 and conversely, in the extended position, the guide tabs 220 can be located at or near the top ends of the guide slits 140.

It will be appreciated that the teachings of the present disclosure can be implemented in any number of different forms and the gingerbread house construction illustrated herein is merely exemplary in nature and not limiting of the scope of the present disclosure. Thus, the gift card carrier of the present disclosure can be broadly described as including a first part that is partially received within and moves relative to a second part via a guide mechanism (e.g., guide tabs and guide slots) and the first part is formed of two different materials with one material preferably being a transparent material. The physical structure and look of the two parts can take any number of different forms (e.g., different shapes and sizes). For example, the card carrier could be in the form of a cookie jar in which the removable lid is the first part that includes the transparent element and the base of the cookie jar is the second part. To reveal the gift card, the recipient can simply lift the lid of the cookie jar from the base (cookie jar) and the gift card is revealed.

It is to be understood that like numerals in the drawings represent like elements through the several figures, and that not all components and/or steps described and illustrated with reference to the figures are required for all embodiments or arrangements. Further, the terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof.

It should be noted that use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements. Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

Overall, the subject matter described above is provided by way of illustration only and should not be construed as limiting. Various modifications and changes can be made to the subject matter described herein without following the example embodiments and applications illustrated and described, and without departing from the true spirit and scope of the present invention, which is set forth in the following claims.

What is claimed is:

1. A gift card carrier for holding a gift card comprising:

a first part having a first portion and a second portion that is formed of a transparent plastic material and includes a pair of gift card slits for releasably retaining the gift card; and a second part that has an open interior space;

wherein the second portion is sized to carry the gift card and be received within the open interior space of the second part;

wherein the first part moves between a fully retracted position in which the second portion is received within the open interior space and an extended position in which the second portion is exposed for removal of the gift card; wherein the first portion of the first part includes a first layer and a second layer with one end of the second portion being captured between the first and second layers.

2. The gift card carrier of claim 1, wherein the first portion of the first part and the second part is formed of a paper material.

3. The gift card carrier of claim 1, wherein the second portion has a pair of guide tabs and the second part that has a pair of guide slits formed in at least one face thereof, the guide tabs passing through the guide slits for controlling movement of the first part relative to the second part.

4. The gift card carrier of claim 3, wherein the pair of guide tabs are located at a bottom end of the second portion and extend laterally outward and pass through the pair of guide slits and are disposed along an exterior surface of the second part.

5. The gift card carrier of claim 3, wherein the second part includes a first layer and a second layer that is attached to the first layer along three sides with a fourth side being open to define an entrance into the open interior space, wherein the pair of guide slits are formed in the first layer.

6. The gift card carrier of claim 3, wherein the pair of guide slits are formed parallel to one another.

7. A gift card carrier for holding a gift card comprising:

a first part having a first portion and a second portion that is a separate structure relative to the first portion and is fixedly attached to the first portion, the second portion having a pair of guide tabs; and a second part that has an open interior space and has a pair of guide slits formed in an exterior face of the second part, the guide tabs passing through the guide slits and being exposed along the exterior face of the second part for controlling movement of the first part relative to the second part;

wherein the second portion is sized to carry the gift card along one outer surface thereof and be received within the open interior space of the second part;

wherein the first part moves between a fully retracted position in which the second portion is received within the open interior space and an extended position in which the second portion is exposed for removal of the gift card;

wherein the second portion, including the pair of guide tabs, is formed of a transparent PVC material, while the first portion of the first part and the second part are each formed of a non-transparent material, thereby allowing the exterior face of the second part to be viewed underneath the guide tabs of the second portion of the first part.

8. The gift card carrier of claim 7, wherein the first portion of the first part include a first layer and a second layer with one end of the second portion of the first part being captured between the first and second layers.

* * * * *